US005399028A

United States Patent [19]

Raasch

[11] Patent Number: 5,399,028

[45] Date of Patent: Mar. 21, 1995

[54] SUPPORT DISK ASSEMBLY FOR A BEARING OF A SPINNING ROTOR

[75] Inventor: Hans Raasch, Moenchengladbach, Germany

[73] Assignee: W. Schlafhorst AG & Co., Moenchengladbach, Germany

[21] Appl. No.: 114,139

[22] Filed: Aug. 30, 1993

[30] Foreign Application Priority Data

Sep. 1, 1992 [DE] Germany ..... 42 29 154.2

[51] Int. Cl.[6] ..... D01H 1/24; F16C 13/00

[52] U.S. Cl. ..... 384/549; 57/103

[58] Field of Search ..... 384/549; 57/103, 406, 57/337, 339

[56] References Cited

U.S. PATENT DOCUMENTS

| | | | |
|---|---|---|---|
| 3,183,730 | 5/1965 | Scragg et al. | 384/549 X |
| 3,901,011 | 8/1975 | Schuster | 57/339 |
| 3,996,653 | 12/1976 | Faris et al. | 57/103 X |
| 4,676,673 | 6/1987 | Stahlecker et al. | 57/103 X |
| 4,890,942 | 1/1990 | Raasch | 384/549 |
| 4,892,422 | 1/1990 | Stahlecker | 384/549 |
| 4,893,946 | 1/1990 | Tesh et al. | 384/549 |
| 4,893,947 | 1/1990 | Hurley | 384/549 |
| 4,896,976 | 1/1990 | Stahlecker | 384/549 |

FOREIGN PATENT DOCUMENTS

| | | |
|---|---|---|
| 3205566 | 8/1983 | Germany . |
| 3630257 | 9/1986 | Germany . |
| 4019028A1 | 12/1991 | Germany . |
| 4019029A1 | 12/1991 | Germany . |

*Primary Examiner*—Thomas R. Hannon

*Attorney, Agent, or Firm*—Shefte, Pinckney & Sawyer

[57] ABSTRACT

A support disk assembly and a method of producing a support disk (1) for the bearing of a spinning rotor. The support disk assembly (1) has an exchangeable annular collar (4) that can be secured between fastening rings (5, 6, or 17). The collar (4) has side surfaces (8,9) that extend parallel and orthogonally to the center axis (M) of the support disk assembly in a radially inward annular region (P). The side surfaces (8,9) located in a radially outward annular region (K) of the collar (4) extend convergently and are partly clamped by flanges (14) on the fastening rings (5, 6, or 17), leaving the peripheral bearing surface (10) of the collar exposed for supporting engagement of the rotor shaft.

7 Claims, 3 Drawing Sheets

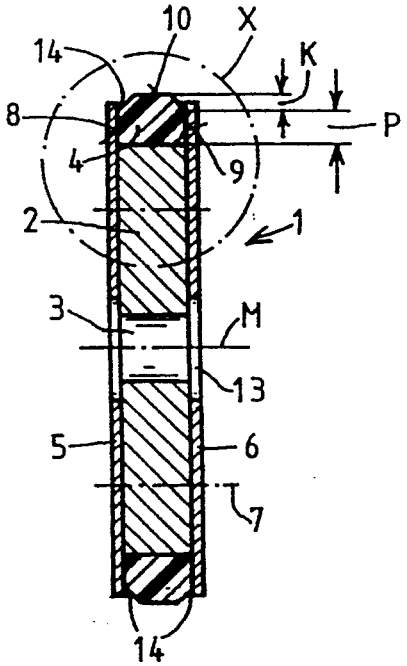
FIG. 1
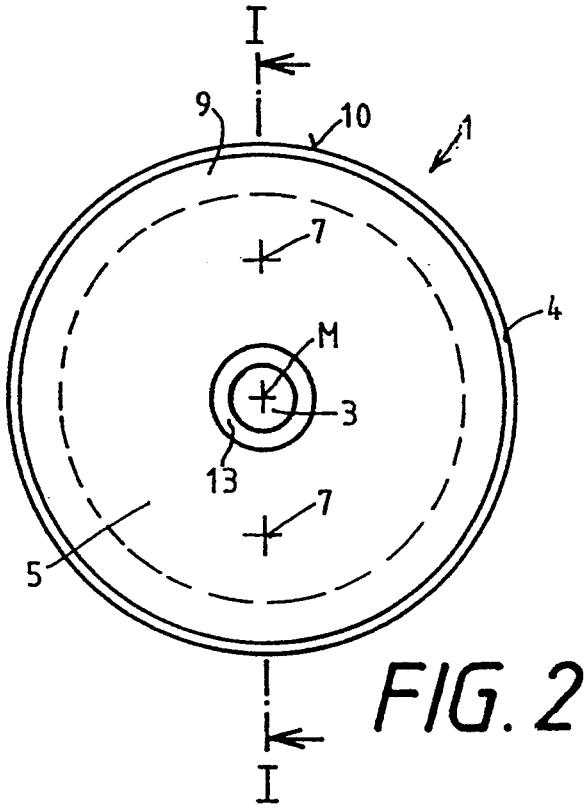
FIG. 2
FIG. 5
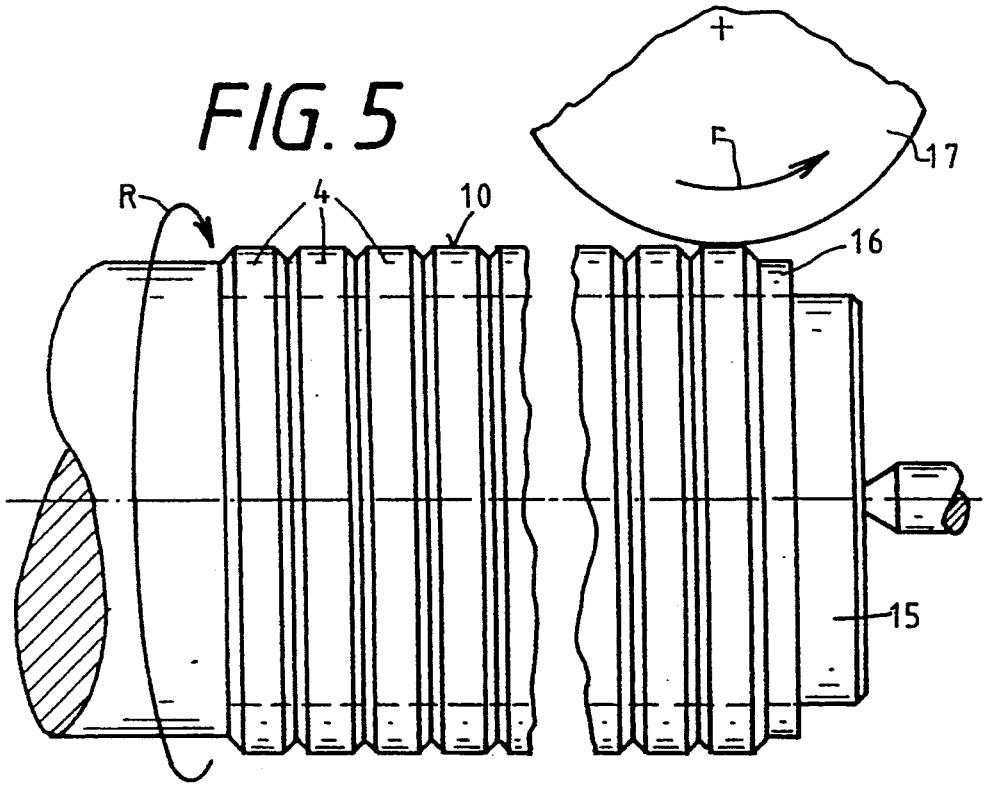

SUPPORT DISK ASSEMBLY FOR A BEARING OF A SPINNING ROTOR

FIELD OF THE INVENTION

The present invention relates to a support disk assembly for rotatable mounting alongside one or more like support disk assemblies to form a bearing for a textile yarn spinning rotor, wherein the support disk assembly has a main body having a peripheral rim, an exchangeable annular collar, and collar-holding elements that can be secured to the main body to fasten the collar to the rim.

BACKGROUND OF THE INVENTION

Support disk bearings for open-end spinning machines as known from German Patent Disclosure DE 40 19 029 have four paired support disk assemblies connected via bearing shafts. In this case, the support disk assemblies are disposed such that their respective circumferential peripheries form a wedge-shaped gap between them, in which the rotary shaft of the spinning rotor is supported while being driven by a tangential belt. This type of bearing is suited for the highest rotary rpm with a satisfactory service life.

The support disk assemblies of such support disk bearings typically comprise a disk-shaped main body preferably of aluminum that has a central axial bore to receive the bearing shaft, and a annular collar disposed at the outer circumference of the peripheral rim of the main body to form a peripheral bearing surface. In most cases, the collar comprises an abrasion-resistant elastomer that is fixedly attached to the rim by means of gluing or vulcanization.

Because of the high rotational speed of the rotary shaft, the annular collar is exposed to a relatively high amount of wear. Although the attainable service life of such support disk bearings is relatively long overall, defects on the annular collar are the most common cause of bearing damage.

With the support disk assemblies used presently, it is hardly possible, or at the least very uneconomical, to refurbish worn support disk assemblies, because, for example, the annular collar is difficult to remove. It has therefore been standard practice up to now to change the entire support disk bearing when the annular collar of a support disk assembly is damaged.

In the past attempts were made to make the operation of an open-end spinning machine more economical through the use of low-priced support disk assemblies; however, the proposed support disk assemblies have certain disadvantages.

For example, a support disk is known from German Patent Disclosure DE 32 05 566 A, wherein a rim is formed from a one-piece, shell-like, sheet metal machined part. A plastic annular collar is injection-molded onto the sheet metal machined part. Support disk assemblies of this type that are produced as sheet metal drawn pieces are more cost-effective to produce than support disk assemblies whose rims are formed by a main body made entirely of aluminum, but the fundamental problem of replacing the entire support disk when the collar is worn could not be solved.

A support disk with an exchangeable annular collar is known from German Patent Disclosure DE 36 30 257 A (U.S. Pat. No. 4,890,942). This known support disk assembly has a disk body formed of two disk members whose respective annular clamping rims serve as clamping portions to secure the annular collar. The disk members can be connected via connecting elements to cause the clamping portions of their respective rims to partially clamp a radially inward extent of the side surfaces of the annular collar that extend convergently in the direction of the collar's peripheral bearing surface. The most significant disadvantage of these support disk assemblies is their inadequate true-running characteristics.

DE 40 19 029 A, identified above, discloses a similar design for a support disk assembly wherein a central main body that forms a peripheral rim and two lateral holding elements secure exchangeable annular collars, but the running collars in this support disk assembly also have the disadvantages known from DE 36 30 257 A.

SUMMARY OF THE INVENTION

Departing from the above-described prior art, the object of the present invention is to create a support disk assembly that is economical to produce and operate.

Briefly summarized, the support disk assembly of the present invention basically comprises a main body having a rim, an exchangeable annular collar, and collar-holding elements securable to the main body for fastening the collar to the rim thereof. The annular collar has at least one radially inner annular region with side surfaces that extend parallel to one another and a radially outer annular region with side surfaces that extend convergently, with a peripheral bearing surface being formed adjacent the outer annular region.

Preferably, the parallel side surfaces of the inner annular region are disposed orthogonally to the center axis of the support disk assembly and extend across a significantly more extensive portion of the annular collar's radial thickness than the convergent surfaces of the outer annular region. When engaged by the collar-holding elements, the relatively larger parallel side surfaces produce sufficient frictional or holding forces for the annular collar with only slight axial pressure. The weak axial forces do not deform the collar radially, so the collar's true-running characteristics are not impaired.

Such an embodiment of the collar is particularly advantageous with regard to manufacturing production, because the relative larger parallel side surfaces of the collars form good handling surfaces that permit a common tightening of a plurality of collars disposed next to each other in a processing station, for instance. In this way a cost-effective grinding or other finishing of the collars, which must be finished to very exact tolerances, particularly with regard to the true-running characteristics, is possible.

In a further development of the invention, it is also provided that the outer annular region in which the side surfaces of the annular collar extend convergently, is disposed adjacent or adjoins the peripheral bearing surface of the collar. With a collar mounted on the main body of the support disk assembly, the convergently extending side surfaces are then clamped over a large surface by flanges disposed on fastening rings that are secured to the main body. The fastening rings secure the collar in both the axial and radial directions and ensure that the exchangeable collar retains its exact preset shape, which assures perfectly true running of the collar during rotation.

Further details of the present invention are to be taken from an exemplary embodiment described below in conjunction with the drawings.

BRIEF DESCRIPTION OF THE DRAWINGS

FIG. 1 is a diametric cross-sectional view of a support disk assembly of the present invention taken along section I—I in FIG. 2;

FIG. 2 is a front elevational view of a support disk assembly of the present invention;

FIG. 5 is a schematic side elevational representation of a device for finishing the annular collars of support disk assemblies;

DESCRIPTION OF THE PREFERRED EMBODIMENT

Figure 3:
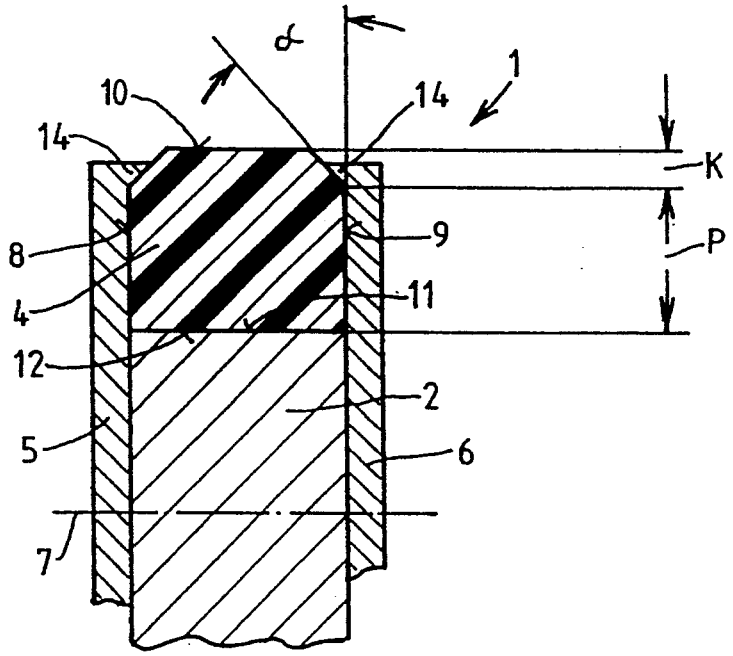
FIG. 3 is a partial enlarged cross-sectional view of the area X of the support disk assembly of FIG. 1.

A support disk assembly according to the present invention is shown in section in FIG. 1 and in a front elevational view in FIG. 2 and as a whole is identified by the reference numeral 1. As is known, and therefore not shown in greater detail, four such support disk assemblies 1 typically form a support disk bearing for the rotor shaft of a spinning rotor. The support disk assemblies 1 are disposed in pairs on respective bearing shafts, with the respective end regions of each bearing shaft being secured in axial bores 3 of its respective support disk assemblies 1.

The support disk assembly 1 essentially comprises a main body 2, an annular collar 4, and lateral fastening rings 5,6. The main body 2, preferably embodied as a solid body of a relatively light metal such as aluminum, has an axial bore 3 and a circumferential rim surface 11 for receiving the collar 4.

Figure 4:
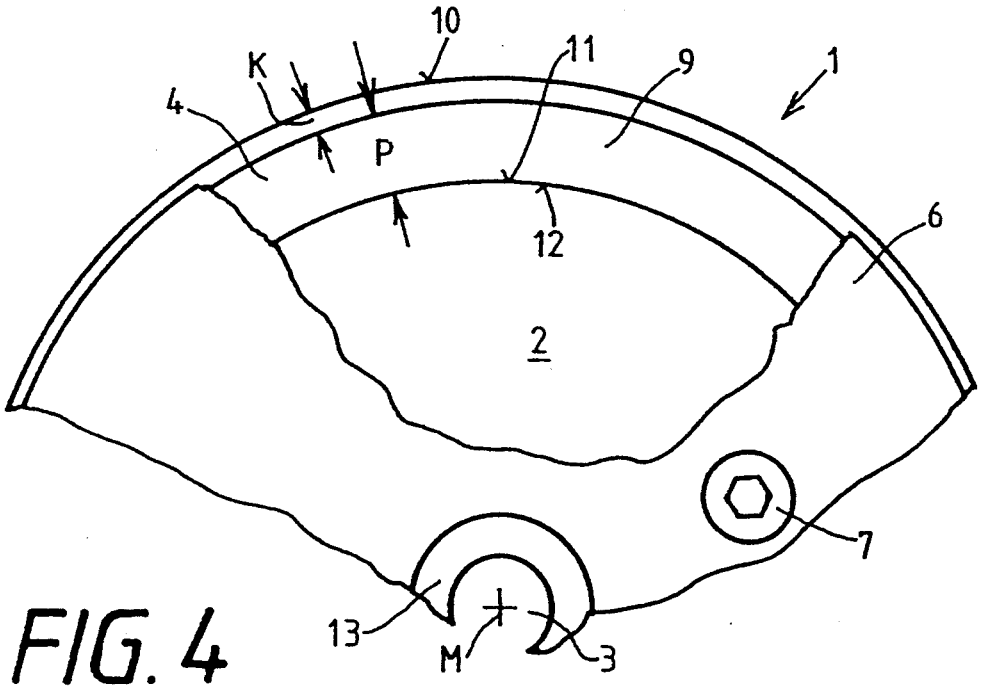
FIG. 4 is a partial enlarged front elevational view of the support disk assembly, with the fastening rings partly broken away.

As can be seen from FIGS. 3 and 4, the annular collar 4 rests with its radially inward mounting surface 12 on the outer circumferential surface 11 of the main body 2 and is secured in this position by means of opposing fastening rings 5,6. The fastening rings 5,6 have aligned central annular openings 13 and peripheral flanges 14 in the region of their outer circumference and are secured to the main body 2 via fastening elements 7.

The annular collar 4 is usually manufactured from an abrasion-resistant elastomer and has a peripheral circumferential bearing surface 10 opposite the mounting surface 12 on which the rotor shaft of the spinning rotor rotates at up to 100,000 $min^{-1}$. Lateral side surfaces 8,9 of the collar 4 extend between the mounting surface 12 and the bearing surface 10, and are parallel with one another through a radially inward annular region P and converge toward one another through a radially outward annular region K. In this case, the parallel sections of the side surfaces 8,9 extending in the inner region P are disposed orthogonally to the center axis M of the support disk 1. The outer region K adjoins the inner region P wherein the side surfaces 8,9 extend convergently. The angle $\alpha$ between the respective extents of the side surfaces extending orthogonally to the center axis M and the extents thereof extending convergently is between about 45° and 90° and preferably 75°.

The radially outward annular region K of the side surfaces 8,9 is clearly more narrow in radial thickness dimension (e.g., 3–6 mm or preferably about 4 mm) than the inner annular region P and is clamped at its radially innermost extent over a large surface by the flanges 14 on the fastening rings 5,6 so as to be held precisely in the radial direction, which is absolutely necessary in view of the exact true rotation required under high rpm.

Figure 6:
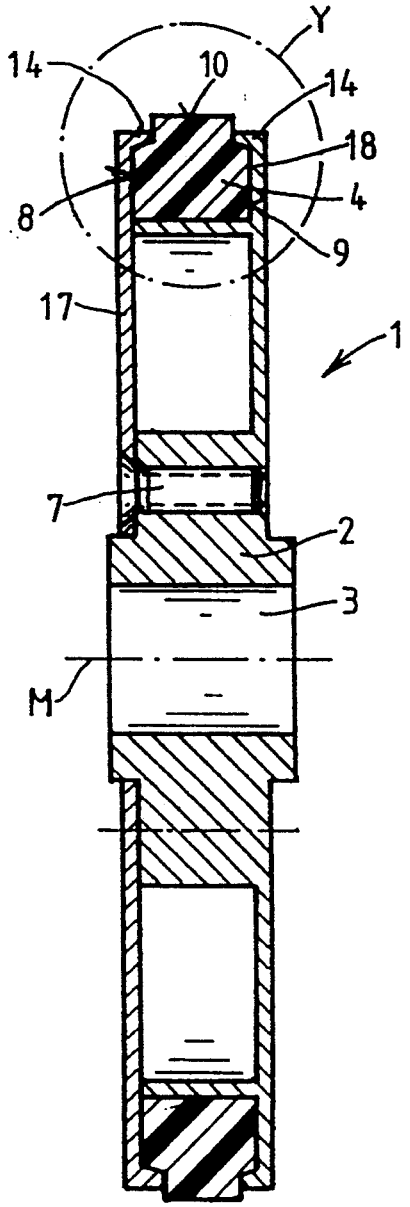
FIG. 6 is a diametric cross-sectional view of a further embodiment of the support disk assembly.
Figure 7:
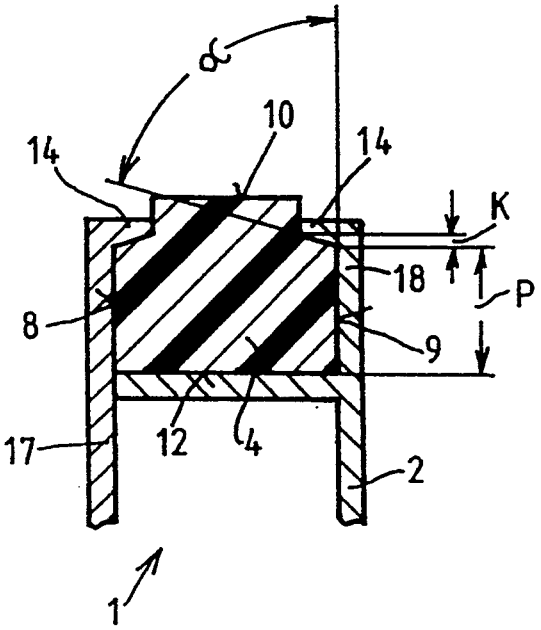
FIG. 7 is a partial enlarged cross-sectional view of the area Y of FIG. 6.

FIGS. 6 and 7 show a further exemplary embodiment of the support disk 1.

In this embodiment, the main body 2 has a cheek 18 on which a circumferential flange 14 is formed. A fastening ring 17 that likewise has a circumferential flange 14 at its outer circumference can be secured to the main body 2 via fastening elements 7. An annular collar 4 having convergently extending side surface regions is axially and radially secured between the fastening ring 17 and the cheek 18 of the main body 2 during support disk operation, with the converging portion of the collar's side surfaces being clamped by the flanges 14.

The collars 4 have a small side surface area adjoining their peripheral bearing surface 10 that extends parallel and orthogonally to the center axis M of the support disk assembly and which is adjoined by an annular region K with the convergently extending portions of the side surfaces 8,9. The region K is significantly smaller in radial thickness than a subsequent radially inward annular region P, which again has side surfaces that extend parallel.

The shapes of the annular collars in accordance with the invention are advantageous, particularly with respect to manufacture of these parts with exact tolerances, because the relatively large parallel sections of the side surfaces permit an economical common process of a number of annular collars.

As indicated in FIG. 5, a number of the annular collars 4 in a processing station can be slid onto a common centering means 15, whose diameter corresponds to the diameter of the main body 2 of the support disk assembly 1 and which are secured thereon by a locking means 16. The collars 4 as thusly clamped securely onto the centering means 15 rotate therewith in the direction of rotation R and are ground to exact tolerances by a grinding device 17 that rotates in the direction r.

By means of the present invention, it is therefore possible to produce such exchangeable annular collars economically because of the parallel side surface regions which make secure handling of the collars particularly easy.

The convergently extending side surface regions thus ensure that the exchangeable collars can be securely fastened to the main body and that the true rotation of the collars necessary because of high rpm is precisely maintained.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A support disk assembly for use in a bearing assembly for a spinning rotor comprises a main body having a rim, an exchangeable annular collar, and collar-holding elements securable to the main body for fastening the collar to the rim thereof, wherein the annular collar (4) has at least one radially inner annular region (P) with side surfaces (8,9) that extend parallel to one another, and a radially outer annular region (K) with side surfaces that extend convergently, the outer annular region (K) having a smaller radial dimension than the inner annular region (P), and a peripheral bearing surface (10) adjacent the outer annular region (K).

2. The support disk assembly as defined by claim 1 wherein the parallel side surfaces (8,9) of the inner annular region (P) of the collar (4) are disposed orthogonally to a center axis (M) of the support disk (1).

3. The support disk assembly as defined by claim 1 wherein the inner annular region (P) has a radial dimension between 3 and 6 mm.

4. The support disk assembly as defined by claim 3 wherein the inner annular region (P) has a radial dimension of 4 mm.

5. The support disk assembly as defined by claim 1 wherein the collar-holding elements are fastening rings (5, 6, or 17) secured to the main body (2) of the support disk assembly (1) and have peripheral flanges (14) to at least partly clamp a radially-inward annular extent of the convergently extending side surfaces (8,9) of the annular collar (4).

6. The support disk assembly as defined by claim 1 wherein the convergently extending side surfaces of the outer annular region (K) of the collar (4) are disposed at an inclined angle ($\alpha$) of about 45° or greater with respect to the adjacent parallel-extending side surfaces (8,9) .

7. The support disk assembly as defined by claim 6 wherein the angle of inclination $\alpha$ is approximately 75°.

* * * * *